United States Patent [19]

Bernath

[11] 4,144,836

[45] Mar. 20, 1979

[54] APPARATUS FOR THE VACUUM IMPREGNATION OF BOARDS OR PANELS OF POROUS MATERIAL

[75] Inventor: Oskar Bernath, Umiken, Switzerland

[73] Assignee: Georg Fischer AG Brugg, Brugg, Switzerland

[21] Appl. No.: 793,314

[22] Filed: May 3, 1977

[30] Foreign Application Priority Data

May 6, 1976 [CH] Switzerland ..... 5669/76

[51] Int. Cl.[2] ..... B05C 3/20

[52] U.S. Cl. ..... 118/7; 118/50; 118/421; 118/504

[58] Field of Search ..... 118/50, 50.1, 421, 504, 118/7; 427/294; 21/68

[56] References Cited

U.S. PATENT DOCUMENTS

| | | | |
|---|---|---|---|
| 1,496,309 | 6/1924 | Girvin | 118/421 X |
| 1,746,826 | 2/1930 | Farr, Jr. | 118/50 |
| 1,835,004 | 12/1931 | Bleecker | 118/504 |
| 1,974,918 | 9/1934 | Hanson | 118/50 X |
| 2,066,379 | 1/1937 | Wright | 118/50 X |
| 2,290,671 | 7/1942 | Camilli et al. | 118/50 X |
| 3,226,255 | 12/1965 | Cieniewicz et al. | 118/504 X |
| 3,566,891 | 3/1971 | Koch | 118/421 X |
| 3,850,136 | 11/1974 | Ruzzo | 118/50 X |
| 3,876,449 | 4/1975 | Smith et al. | 427/294 X |
| 3,895,138 | 7/1975 | Sewell et al. | 118/7 X |
| 3,962,989 | 6/1976 | Groff, Sr. | 118/504 |
| 4,022,156 | 5/1977 | Esterline | 118/504 |

FOREIGN PATENT DOCUMENTS

| | | | |
|---|---|---|---|
| 6815392 | 5/1970 | Netherlands | 427/294 |
| 826176 | 12/1959 | United Kingdom | 427/294 |

*Primary Examiner*—Wm. Carter Reynolds
*Attorney, Agent, or Firm*—Toren, McGeady and Stanger

[57] ABSTRACT

The apparatus includes a horizontal receiving substrate having a resilient gasket extending over the top surface in a closed figure and spaced from the edge of the substrate. A movable cover member including an inverted shallow chamber is provided with a matching resilient gasket on the underside. Vacuum means are connected to the cover. Means are provided for moving the transport cover and substrate into opposing positions so that a porous panel is clamped with between the cover and the substrate gaskets to seal off the major surface portions of the top and bottom faces of the panel while leaving a peripheral region, including the edge, exposed. A tank containing a fluid medium is arranged to move up and around the substrate so that the fluid medium in the tank contacts the surface of the peripheral region of the panel to achieve impregnation. A vacuum is drawn on the cover chamber so that the fluid medium is drawn into the peripheral regions of the panel. Also disclosed is an arrangement with a tank surrounding the perimeter of the substrate and having a means for changing the level of fluid medium in the tank. The level can be changed by inserting a displacement member into the fluid medium or by forcing the fluid medium into the tank from a hyperbaric reservoir chamber.

11 Claims, 5 Drawing Figures

APPARATUS FOR THE VACUUM IMPREGNATION OF BOARDS OR PANELS OF POROUS MATERIAL

BACKGROUND OF THE INVENTION

The present invention relates generally to apparatus for selectively contacting peripheral surface regions of a porous panel workpiece with a fluid medium, and relates particularly, but not exclusively, to such apparatus for impregnating panels of pressed particle composition with a supplementary binder.

Pressed particle composition panels, variously referred to also "chipboards", "pressboards", "composition boards", and "particle boards", are used for various structural purposes in place of wood or other structural materials. Typically they are made by wetting particulates such as wood chips with a binder and then similtaneously pressing the mixture of particles and binder into the desired shape and curing the binder.

Because the binder is both costly and rather heavy as compared to the particles, a minimum amount of the binder is used. This leaves the edges or peripheral regions of the board somewhat fragile. This is a disadvantage in that the peripheral regions are most likely to be used for fastening, and therefor must be rugged.

One way to reinforce the edges of the board is to impregnate them with supplementary binder material. Such an approach is described, for instance, in the Swiss Pat. No. 577,378. However, heretofore this type of impregnation has not been developed into a sufficiently high speed process to be commercially viable on a large scale.

SUMMARY OF THE INVENTION

The novel apparatus in accordance with the present invention includes means for automating and speeding certain steps involved in the impregnation of panel peripheral regions, so that high speed production can be better served.

DESCRIPTION OF THE PREFERRED EMBODIMENTS

EXAMPLE I

Figure 1:
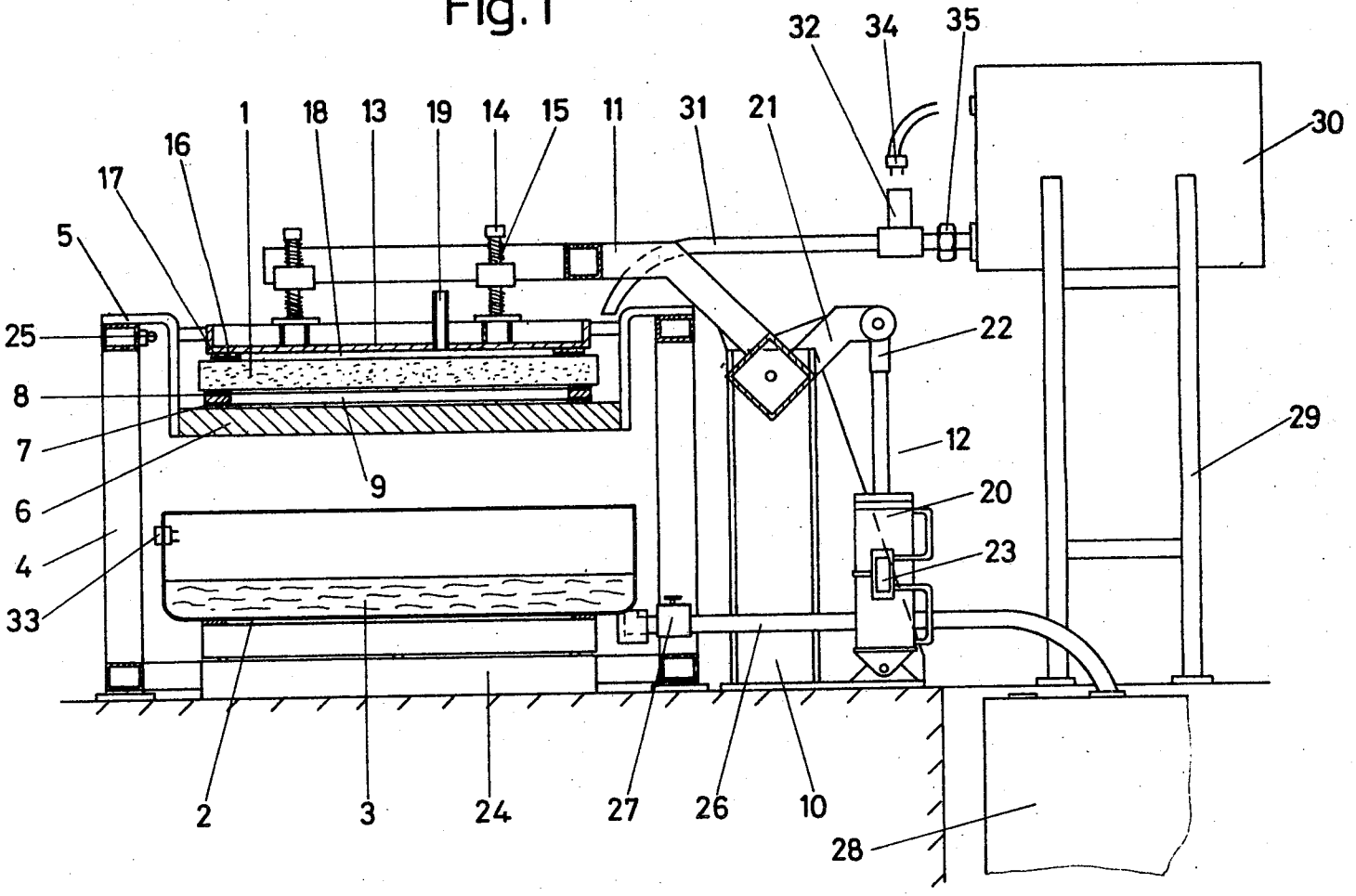
FIG. 1 is a partially sectioned, front elevational view of an apparatus in accordance with a first preferred embodiment of the present invention and shown in a first stage of its operation.
Figure 2:
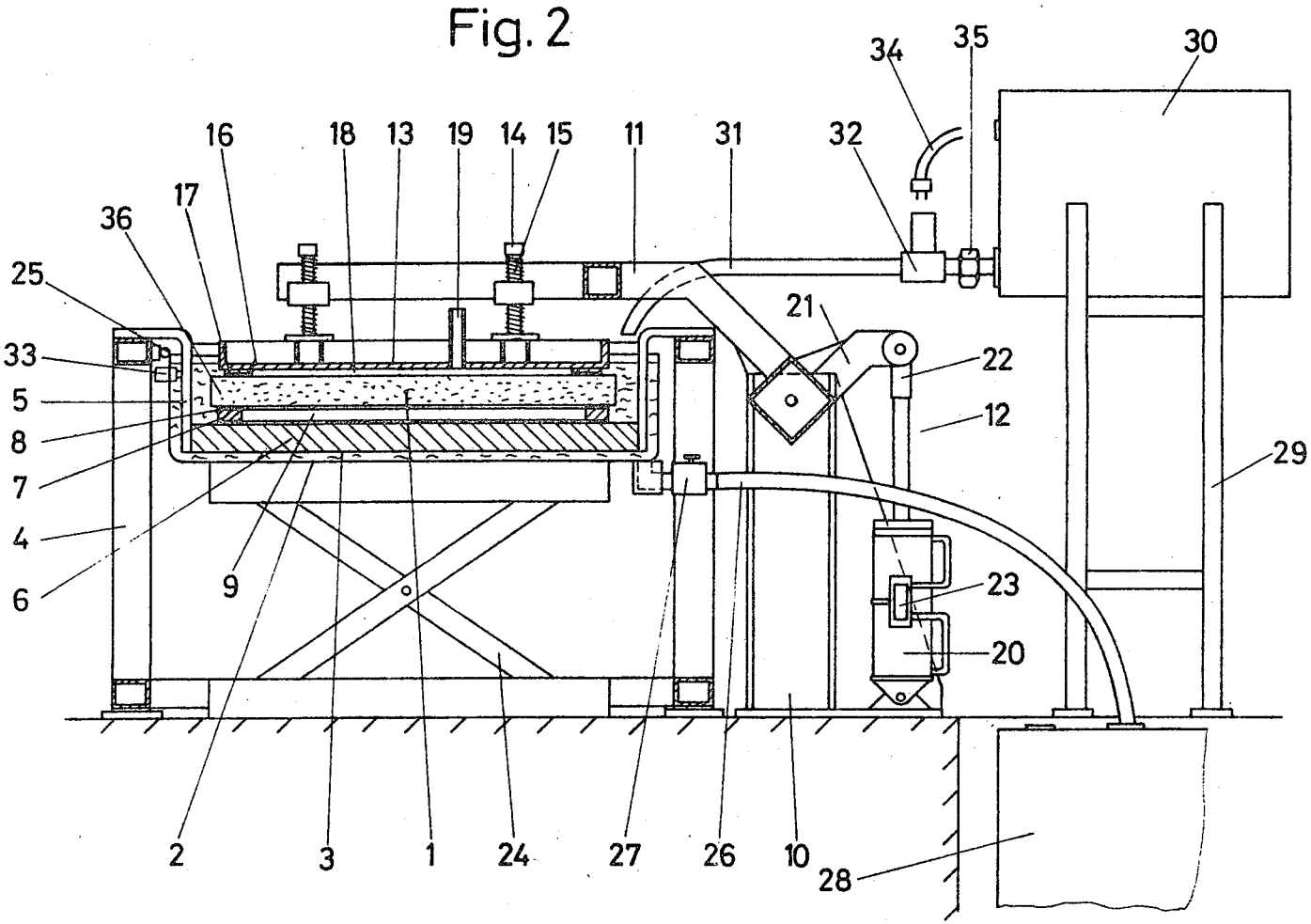
FIG. 2 is a partially sectioned, front elevational view of the apparatus of FIG. 1 in a second stage of its operation.

FIGS. 1 and 2 show an apparatus in accordance with a first embodiment of the present invention. The apparatus is for impregnating the peripheral regions or edge portion of a porous panel member with a supplementary binder to provide structural reinforcement of the edge of the panel. The FIGS. 1 and 2 have like reference numerals for the elements of the apparatus and show the apparatus in two different stages of operation.

Referring now to FIGS. 1 and 2, the apparatus includes fixed support means in the form of a substrate base 6 secured on a frame 4 by means of members 5 and a bottom gasket frame 7 to support a panel 1 for treatment. Frame 7 is provided with a resilient support gasket 8, e.g. of rubber, so that a sealed chamber 9 forms between a panel 1 resting thereon under pressure, and the base 6.

The panel 1 consists essentially of porous material and is formed with a pair of generally planar opposed surfaces with edge portions extending thereabout to define the periphery of the panel 1.

A pivoting frame 11 is mounted to pivot through approximately 90° by means of a pivot drive 12 on a frame 10 disposed adjacent the frame 4. A transport cover 13 forming movable cover means operates is to fit against the panel 1 and is resiliently suspended from the frame 11 by means of bolts 14 and springs 15. A top gasket frame 16 is secured to the cover 13 and is also provided with a resilient support gasket 17 so that a sealed chamber 18 forms between the cover 13 and the panel 1, a vacuum being produced in chamber 18 by means of a suction line 19 and a vacuum pump (not shown).

In the example illustrated, the pivoting drive 12 consists of a hydraulically or pneumatically operated cylinder 20, which by means of a piston rod 22 engages a lever 21 rigidly secured to frame 11, and is controllable by a solenoid valve 23.

A lifting table 24, preferably a scissors-lift table, is disposed inside the frame 4 and the bath 2 for the agent 3 - e.g. a resin or adhesive - is secured thereon.

FIG. 1 shows the bath 2 in the bottom starting position while FIG. 2 shows the top position, the fluid binding agent 3 surrounding the panel 1 for treatment. A limit switch 25 disposed on the frame 4 indicates the corresponding position of the bath 2. An outflow conduit 26 containing a shut-off valve 27 connects bath 2 to a lower-level empty tank 28 into which the agent 3 can be discharged.

Laterally of the apparatus discribed above is a frame 29 in which tank 30 of consolidating or cleaning agent available directly from the trade can be inserted, the tank 30 being disposed at a level such that a free flow is possible to the bath 2 even when the latter is in the top position (FIG. 2), by means of a flexible pipe 31 containing a control valve 32 - e.g. a solenoid valve — which is operatively connected by a plug-in line 34 to a level indicator 33 - e.g. a level sensor — disposed on the bath 2. Pipe 31 with control valve 32 can be connected by means of the union 35 to the tank 30 containing the liquid required at any time.

Alternatively, the tank 30 may be equipped with a control valve and a pipe 31 in which case only the plug-in line 34 is connected to the control valve 32 disposed on the tank 30 containing the required liquid.

The embodiment described above operates as follows:

Cover 13 is open, i.e., it is brought into a substantially vertical charging position by means of the pivoting frame 11 and pivoting drive 12, so that the bottom frame 7 is freely accessible. A manipulator (not shown in detail) disposed adjacent frame 4 places a panel 1 for treatment on frame 7 of base 6. Cover 13 is brought into the operative position shown in FIGS. 1 and 2 by means of pivoting drive 12 by actuation of the cylinder, the panel 1 being clamped under pressure between the two frames 7 and 16, the two sealed chambers 9 and 18 being formed. Bath 2 is then raised from bottom position (see FIG. 1) by means of lift table 24 and retained in that position when reaching limit switch 25 (see FIG. 2). In this position the level of the consolidating agent 3 is checked by means of the level indicator 33. If the required level is not available, control valve 32 is actuated and agent is fed from tank 30 to bath 2 until a corresponding control signal again closes control valve 32. If a level sensor 33 and solenoid valve 32 are used, this is effected by a simple electric control circuit.

If the required level is already available, or when it is reached by the above-described control process, a vacuum is generated in the chambers 18 and 19 and inside the panel 1 of porous material by means of the line 19 and a pump. Since the edge parts 36 of the panel 1 are maintained in an exposed condition, agent 3 surrounding the panel 1 penetrates into the edge parts 36 of the panel 1 because of the external atmospheric pressure and gives the edge portions the required strength after setting, such as is required for example for fixing parts by means of screws. The depth of penetration depends on the amount of vacuum and its duration and can readily be controlled by a time relay. After the required time has expired, the vacuum is discontinued and the lift table 24 containing the bath 2 is lowered. Advantageously, during cyclic operation bath 2 is lowered only until the level of agent at least reaches the bottom frame 7, and this can be effected by the control system, e.g. by level sensor disposed on the member 5 or by another limit switch disposed on the frame 4.

The cover 13 is then opened, the panel 1 is removed by means of the manipulator, another working cycle starting by insertion of a new panel 1. The cycle may be controlled, for example, fully automatically by means of an electrical sequential control system.

By means of the bath 2 disposed on the table 24 it is thus possible cyclically quickly to lift and lower the level of the liquid 3, and the change of level must correspond at least to the thickness of the panel 1 for treatment.

For cleaning purposes or at the end of the operation the bath 2 is completely lowered by means of the table 24. For cleaning purposes, the valve 27 is opened so that the agent 3 in the bath 2 flows through the line 26 into the empty tank 28. By changing the plug-in line 34 to a control valve 32 disposed on a tank 30 containing cleaning agent, the bath 2 can be raised and then filled with cleaning agent by the filling operation already described, so that the apparatus is cleaned by one or more circulations of the cleaning agent.

EXAMPLE II

Figure 3:
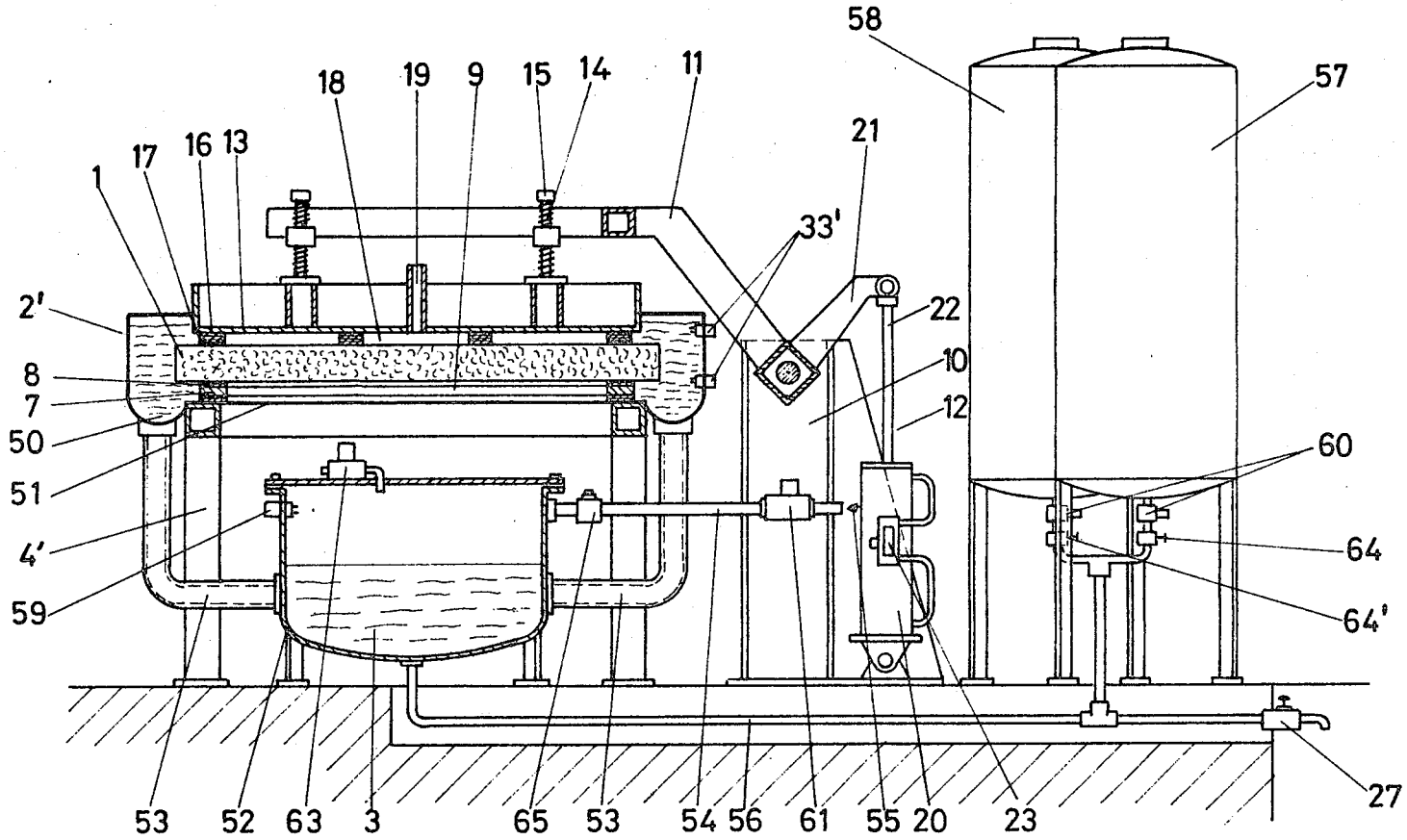
FIG. 3 is a partially sectioned, front elevational view of an apparatus in accordance with a second preferred embodiment of the present invention and shown in a first stage of its operation.
Figure 4:
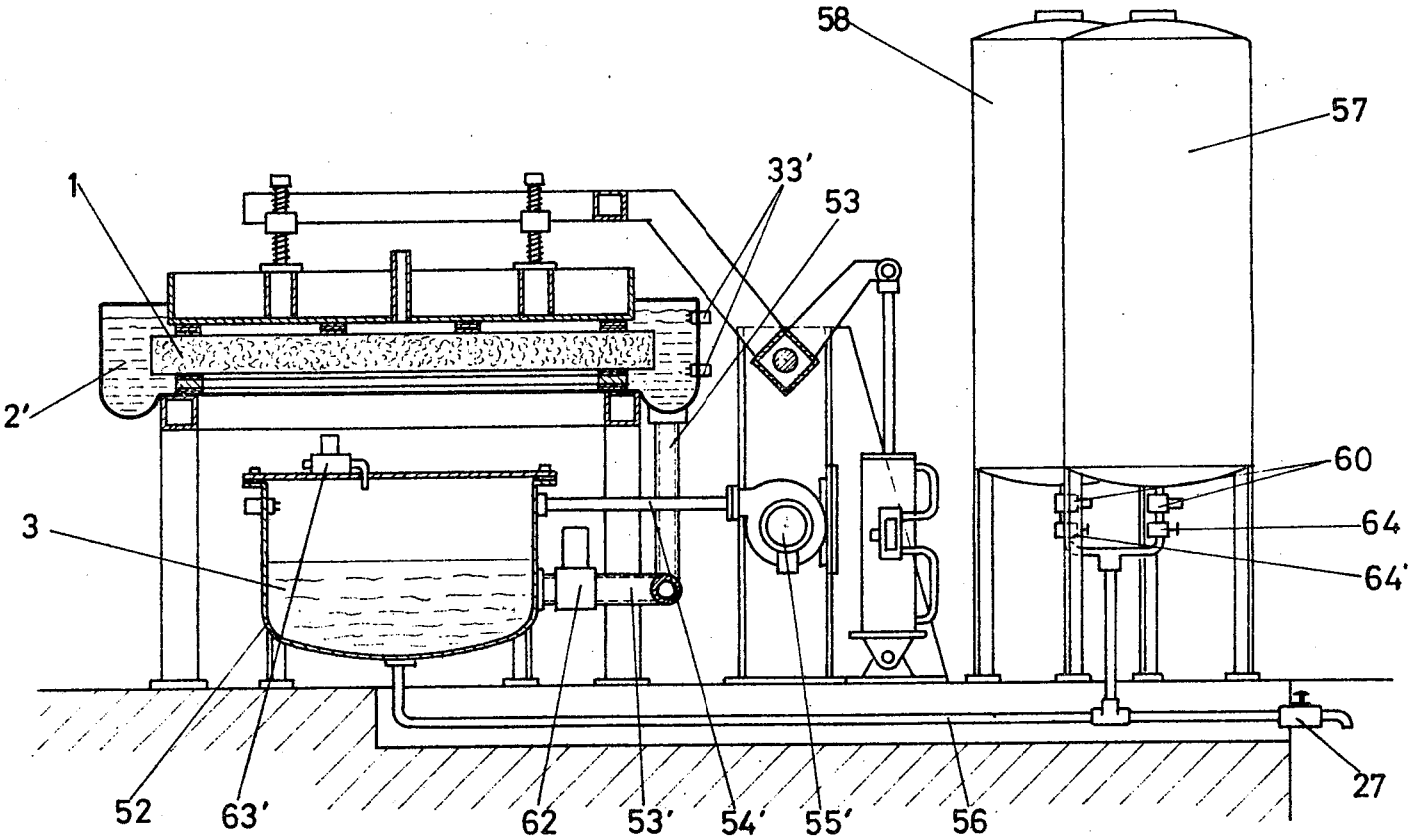
FIG. 4 is a partially sectioned, front elevational view showing an embodiment which differs slightly from the apparatus of FIG. 3 and depicting a second stage of its operation.

FIGS. 3 and 4 show another preferred embodiment of the invention by an apparatus in which the binding agent is cyclically conveyed from a hyperbaric pressure reservoir tank into the fixed bath by means of a gaseous medium, e.g. compressed air.

Referring now to FIG. 3 a bath 2' is fixed on a frame 4', the bath 2' having a semi-circular depression 50 along the periphery at the bottom. The bottom frame 7 is secured in sealing-tight relationship to a raised central portion or base 51 of the bath 2' and is provided with an elastic support 8. The panel 1 for treatment is placed on the frame 7 as already described in connection with FIGS. 1 and 2 and clamped by the pivotable cover 13. The complete pivoting system with the cover and the vacuum production system comprises the same parts as already described in connection with FIGS. 1 and 2. Beneath the frame 4' and under the base 51 of the bath 2' is a pressure tank 52 directly connected to the bath 2' (see FIG. 3) by means of a number of large section feed tube pipes 53. A line 56 connects pressure tank 52 to two reservoirs 57 and 58 for example, one containing consolidating agent and the other cleaning agent. A control valve 60 and a manual shut-off valve 64 and 64' are provided at the outlet of each reservoir. Alternatively, just one control valve 60 - e.g. a solenoid valve - may be disposed in line 56 between tank 52 and valves 64. Opening of one of the valves 64 and 64' enables the liquid required at any time to be conducted to the pressure tank 52. The shut-off valve 27 in line 56 provides general discharge facilities for the various liquids. A level indicator 59, e.g. a level sensor, disposed on the pressure tank is operatively connected to the or each control valve 60, e.g. by means of a lead in the case of electrically controllable units.

Pressure tank 52 is connected by line 54 to a pressure generator 55 for actuation by means of a gaseous medium, preferably compressed air. Line 54 is connected to a compressed air system or directly to a compressor, line 54 containing a throttle valve 65 and a control valve 61. A controllable drain valve 63 is disposed on the cover of pressure tank 52, valve 63 and control valve 61 being operatively connected to one or more level indicators 33' disposed on bath 2'.

In an alternative embodiment shown in FIG. 4, the pressure generator is a radial fan 55' directly connected to the pressure tank 52 via line 54'. A large section control valve 62, e.g. a solenoid valve, is disposed on pressure tank 52 and is connected to a large-section distributor line 53' from which a number of lines 53 lead to bath 2'. A discharge control valve 63' is also disposed on the cover of the pressure tank and is operatively connected, together with control valve 62, to the level indicators 33' disposed at different levels on the bath 2'.

The alternative embodiment shown in FIG. 3 operates as follows:

Manual shut-off valves 64 on reservoir 57 for the binding agent 3 is opened, and then with the control valve 60 on reservoir 57 open and the discharge control valve 63 open, agent 3 flows into the pressure tank 52 until level indicator 59 delivers a signal and closes control valve 60 and discharge control valve 63 so that the inflow is interrupted. With cover 13 open, a panel 1 is placed on frame 7 of empty bath 2' as already described in connection with FIGS. 1 and 2 and clamped as in the first alternative embodiment by the cover being closed. Control valve 61 is then opened to allow compressed air to pass from compressor 55 through line 54 and throttle valve 65 to pressure tank 52, agent 3 being forced into bath 2' via lines 53. The filling time for bath 2' can be adjusted by means of throttle valve 65. After the agent 3 has reached the top level indicator 33', this level is maintained by a control process with alternate closing and opening of control valve 61 and discharge control valve 63, until the agent has penetrated the panel 1 sufficiently deeplly after the vacuum has built up, as already described in connection with FIGS. 1 and 2.

After the vacuum has ceased, the discharge control valve 63 is completely opened and control valve 61 is closed, so that agent 3 flows back from bath 2' to pressure tank 52. During the change of panels 1 for a new operating cycle which takes place as already described, the level in the pressure tank 52 is checked by level indicator 59 and, if necessary, made up by opening of control valve 60.

To obtain short filling times for bath 2', it is advantageous for not all the agent 3 to be returned to the pressure tank 52. Instead, a level adjusted to beneath the panel 1 for treatment is maintained in the bath 2' during the discharging and charging time by means of an air pressure set to a somewhat lower value in line 54, and for this purpose a second level indicator 33' must be disposed at a corresponding height of the bath 2'.

For cleaning purposes when work is completed, the binding agent is first discharged from the pressure tank 52 by opening the shut-off valve 27 with the manual shut-off valve 64 being closed on tank 57. Valve 64' is then opened to connect the apparatus to the cleaning agent tank 58, and cleaning is carried out as already described by circulating the cleaning agent.

In the alternative embodiment shown in FIG. 4, the pressure tank 52 continuously receives air pressure during the working time, e.g. by means of a radial fan 55'. To bring agent 3 into bath 2' valve 63' is closed, the liquid being forced into bath 2' by the air pressure with the control valve 62 open, until the top level is reached so that a signal from the top level indicator 33' closes control valve 62 and the level is maintained. On completion of the process the discharge control valve 63' and the control valve 62 is opened until the level is beneath the panel 1 and a second level indicator 33' disposed at this level transmits the signal to close the two valves 62 and 63'.

If the consolidation process and the change of boards takes a relatively long time, the radial fan 55' can also be switched off for energy economy. At the end of operations, the stock of agent 3 in the pressure tank 52 can be returned to the reservoir 57 with the discharge control valve 63' and the control valve 62 closed and the control valve 60 open. With the operating procedure described here, it is also possible for the apparatus according to FIG. 4 to be cleaned by means of cleaning agent in the reservoir 58.

To intensify the return and flow of binding agent from bath 2' to pressure tank 52, a vacuum can advantageously be rendered operative at pressure tank 52 although not shown in detail in FIGS. 3 and 4. Rapid change of level of the binding agent liquid level is also possible with the apparatus described in connection with these Figures.

Automatic operation is also possible in the exemplified embodiments according to FIGS. 3 and 4, for example by means of an electrical sequential control system.

EXAMPLE III

Figure 5:
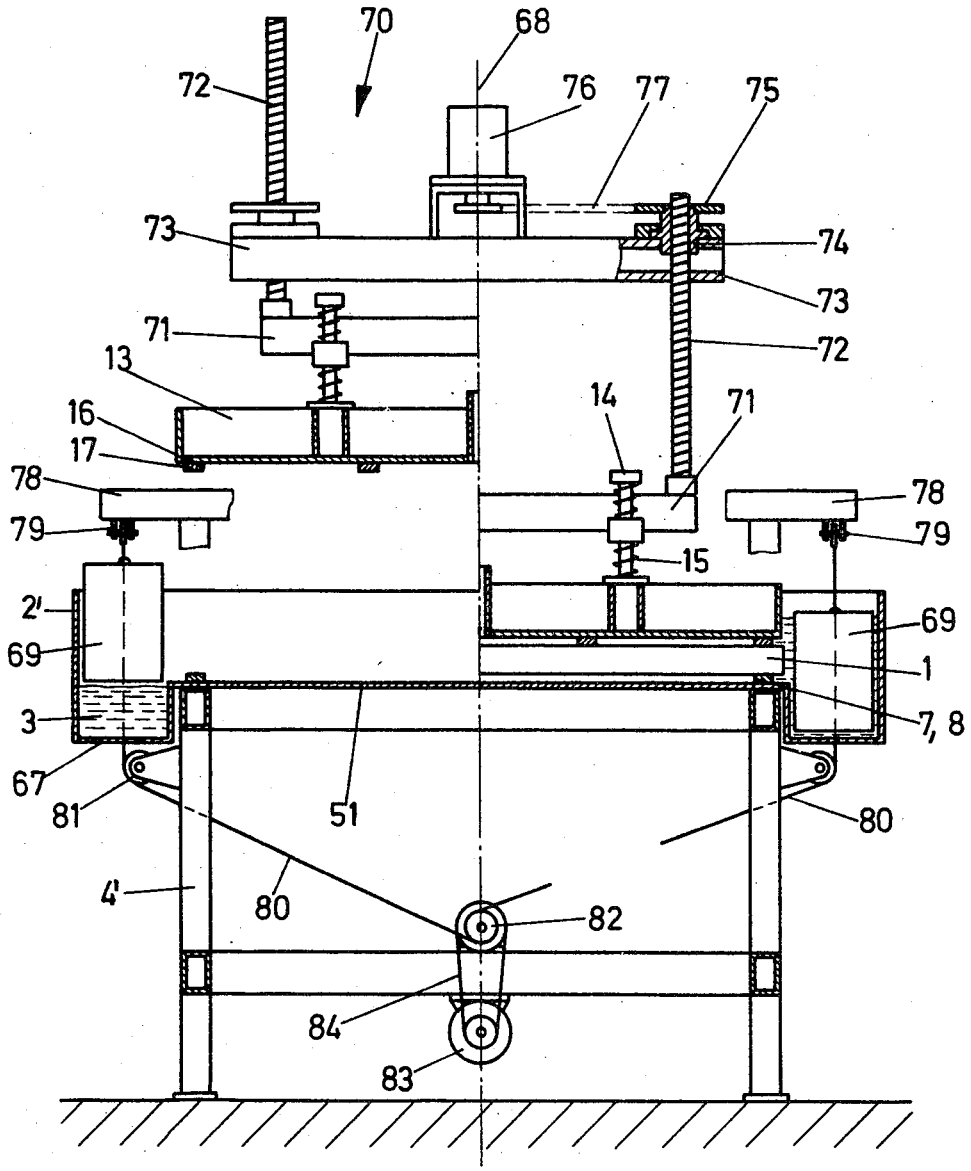
FIG. 5 is a partially sectioned, side elevational view of an apparatus in accordance with a third preferred embodiment of the present invention.

FIG. 5 shows another embodiment of apparatus for vacuum-impregnation of boards 1 in cross-section, the apparatus being shown in the charging position on the left of the centre-line 68 and in the working position on the right thereof.

A frame 4' bears a fixed bath 22" provided with a depression 67 at each of at least the two long sides. The bottom frame 7 is secured directly to the base 51 of the bath 2" and is provided with an elastic support 8. Above the bath 2" is a lifting system 70 which is adapted to raise and lower a cover 13 vertically in the horizontal position. Cover 13 is resiliently suspended from a frame 71 by means of bolts 14 and springs 15. Spindles 72 are secured to the frame 71 and cooperate with nuts 74 rotatable on a member 73. The nuts provided with sprocket wheel 75 are simultaneously driven via a chain drive 77 by means of a motor 76 disposed on member 73. The latter is borne on the frame 4' or on the foundation by means of supports (not shown). As already described in connection with FIGS. 1 and 2, the top frame 16 with the elastic support 8 and suction line 19 is secured to the cover 13.

Above the bath 2" outside the lifting zone of the cover 13 is disposed a frame top part 78 on which reversing pulleys 79 are secured. A line 80 leads to the reversing pulleys 79 via pulleys 81 from a line drum 82 disposed on the frame 4'. A displacement member 69 is disposed at each end of the line. The displacement members 69 are lowerable into the depressions 67 of the bath 2" by means of the cable drum 82 which is adapted to be driven by a geared motor 83 and a chain drive 84, the top and bottom positions of the displacement members being signalled directly by limit switches (not shown) or indirectly via level sensors, to the control system.

The embodiment described above operates as follows:

The cover 13 is in the top charging position and the displacement member 69 is also in the top position so that the liquid 3 is within the depressions 67 (see left-hand section of FIG. 5). A panel 1 for treatment is then placed on the frame 7 inside the bath 2", e.g. by means of a manipulator. Cover 13 is brought down vertically into the operative position by means of the lifting system 70 by the drive of the spindles 72, the board being clamped under pressure between the two frames 7 and 16. The displacement members 69 are then lowered into the depressions 67 of the bath 2" by means of the cable drum 82 so that the level of the consolidating liquid 3 rises to above the top edge of the board (see FIG. 5, on right). Penetration of the liquid 3 by means of a vacuum is again as described in connection with FIGS. 1 and 2. On completion of this process, the displacement member 69 is lifted to lower the level of the liquid again and the cover 13 is brought into the top charging position by means of the lifting system 70, and the panel 1 is removed. The liquid used up can be replenished by means of apparatus as described in connection with FIGS. 1 and 2. The entire operation can be effected fully automatically by means of an electrical sequential control system. Cleaning of the apparatus can again be as in the first embodiment.

The use of manipulators for charging the apparatus with workpieces is ensured by constructing the apparatus with fixed supporting surfaces for the panel or board under treatment and with a pivotable or lowerable cover, so that fully automatic operation is possible and the apparatus can be incorporated in a production line for the production of chipboards for example. The alternative embodiments with the lowerable bath and lowerable displacement members, and those with the pressure tank, ensure short cycle times with low operating and investment costs as a result of rapid supply and discharge of the consolidating agent to the panel or board, and compact construction is also ensured. The apparatus can also be rapidly cleaned at low cost.

What is claimed is:

1. Apparatus for vacuum impregnation of panels consisting essentially of porous material and formed with a pair of generally planar opposed surfaces with edge portions extending thereabout to define the periphery of said panels, said apparatus comprising: means defining a bath of impregnating fluid; fixed support means receiving thereupon panels to be impregnated with said fluid; movable cover meanns removably positionable relative to said fixed support means to maintain a panel to be impregnated in a clamped position therebetween while maintaining said edge portions in an exposed condition; sealing means for defining an enclosed fluid tight chamber between at least one of said opposed planar surfaces of said clamped panel and at least one of said fixed support means and said movable cover means when said panel is in said clamped position; means for effecting immersion of said clamped panel within said bath of impregnating fluid with said edge portions exposed to said fluid; and means for creating a vacuum within said enclosed fluid tight chamber while said clamped panel is immersed within said impregnating fluid to effect aspiration of said impregnating fluid into said clamped panel through said edge portions by the action of the suction effect created within said enclosed fluid chamber by said vaccum means.

2. Apparatus according to claim 1 wherein said sealing means include means for defining a pair of fluid tight chambers, one each adjacent each of said opposed planar surfaces, with one of said chambers being defined between one of said opposed surfaces and said movable cover means and with the other of said chambers being defined between the other of said opposed surfaces and said support means.

3. Apparatus according to claim 1 further including pivotable drive means having said movable cover means mounted thereon and operating to move said cover means from a generally horizontal operative position wherein said cover means is located relative to said fixed support means to clamp a panel therebetween and to an approximately vertically oriented position enabling placement of a panel to be clamped upon said fixed support means.

4. Apparatus according to claim 1 wherein said means defining said bath of impregnating fluid comprises a vat containing said fluid and configured to enable said fixed support means to be received therein together with said movable cover means and said panels to be impregnated, and wherein said immersion means comprise means for lifting and lowering said vat beneath said fixed support means to enable immersion therein of said clamped panels.

5. Apparatus according to claim 4 including impregnating fluid supply means, conduit means in flow communication between said supply means and said vat, valve means for controlling flow of said impregnating liquid from said supply means into said vat through said conduit means and fluid level sensing means operatively associated with said vat to control operation of said valve means.

6. Apparatus according to claim 3 further comprising means resiliently suspending said movable cover means from said pivotable drive means.

7. Apparatus according to claim 3 wherein said pivotable drive means include pivoted frame means having said cover means mounted thereon, hydraulically actuated cylinder means and lever means actuated by said hydraulically actuated cylinder means to effect pivoting of said pivoted frame means.

8. Apparatus according to claim 3 wherein said pivotable drive means include pivoted frame means having said cover means mounted thereon, pneumatically actuated cylinder means and lever means actuated by said pneumatically actuated cylinder means to effect pivoting of said pivoted frame means.

9. Apparatus according to claim 1 further including hoisting means movably mounting said movable cover means over said fixed support means and operative to bring said movable cover means while in an essentially horizontal position into a lower operative position clamping said panels with said fixed support means and into an upper charging position wherein a new panel may be placed on said fixed support means.

10. Apparatus according to claim 1 wherein said means defining said bath of impregnating fluid comprises a vat being formed with a raised central portion and with depressions adapted to hold therein said impregnating fluid at a level below said raised central portions, said immersion means including fluid displacement means adapted to be raised and lowered into said depressions in said vat to raise and lower the level of said fluid in said vat thereby to control immersion of said panel in said impregnating fluid.

11. Apparatus according to claim 9 wherein said hoisting means include motor driven spindle means operative to drivingly raise and lower said cover means.

* * * * *